US006352075B1

(12) United States Patent
Wang

(10) Patent No.: US 6,352,075 B1
(45) Date of Patent: Mar. 5, 2002

(54) SNORKEL TUBE HOLDER

(76) Inventor: Chin-Jen Wang, No. 159, Cheng Kuon Rd., SanChung City, Taipei (TW)

( * ) Notice: Subject to any disclaimer, the term of this patent is extended or adjusted under 35 U.S.C. 154(b) by 0 days.

(21) Appl. No.: 09/481,381

(22) Filed: Jan. 12, 2000

(51) Int. Cl.[7] ..... B63C 11/16
(52) U.S. Cl. ..... 128/201.11; 24/455; 24/457
(58) Field of Search ..... 24/20 R, 19, 455, 24/457; 248/226.11, 316.1; 128/201.11, 200.24

(56) References Cited

U.S. PATENT DOCUMENTS 5,855,044 A * 1/1999 Cradduck ..... 24/20 R
5,979,020 A * 11/1999 Kimura et al. ..... 24/20 R

* cited by examiner

*Primary Examiner*—Glenn K. Dawson
(74) *Attorney, Agent, or Firm*—Troxell Law Office PLLC

(57) ABSTRACT

A snorkel tube holder integrally made of injection molding plastics includes a hollow circular body for securely holding the snorkel tube and a clip for fastening the holder to a strap of a goggle mask. The body has a curved first arm with a bent first lug, a curved second arm pointing in opposite direction against the first arm and has a bent second lug, and a slot separating the first and second arm. By pressing the first and second lug against each other with two fingers of one hand, the holder may be moved quickly along the snorkel tube for adjusting the position of the holder on the tube.

2 Claims, 5 Drawing Sheets

SNORKEL TUBE HOLDER

1. FIELD OF THE INVENTION

This invention relates to a snorkel tube holder and particularly to a snorkel tube holder that may be adjusted and fastened single handed quickly.

2. BACKGROUND OF THE INVENTION

Snorkeling is a popular sport and recreation activity in recent years. A goggle mask is a necessary gear for such activity. FIG. 1 shows a general and conventional goggle mask widely used for snorkeling. It includes a glass A, a snorkel tube B which constitutes a tube member C, a mouth piece D at one end and a top end F, a holder E for holding the tube member C and a clip H attached to the holder E for engaging the snorkel tube B to a strap G of the goggle mask. The holder E usually has a circular opening slightly smaller than the outside perimeter of the tube member C for holding the tube member C securely but also may be moved axially along the tube member C by force to adjust the mouth piece D according to user's head size (FIG. 2A). It may also have an axial slot to make the adjustment easier (FIG. 2B). Nevertheless, the holder E should make forced contact with the tube member C to prevent the snorkel tube B from slipping from the goggle mask when in use. This forced contact makes the moving and adjustment of the position of the holder E difficult. Users have to use two hands to make the adjustment. It becomes very annoying when users are already diving in the water and finding that the goggle masks do not fit comfortably, or the mouth piece position changed due to some incident such as impact by a rough wave, and users have to use two hands to make adjustment forcefully in the deep water. The tight engagement between the holder E and the tube number C also tends to scrape the tube surface after a number of adjustment of the holder E, and makes the snorkel tube unsightly. All of this beg for improvement.

SUMMARY OF THE INVENTION

It is an object of this invention to provide a snorkel tube holder that has a simple structure that may hold the snorkel tube securely without slipping and may also enables a user to change and adjust holder position single-handed quickly, either on land or in water.

The snorkel tube holder according to this invention includes a body integrally made by plastics injection molding. At one side of the body, there is a clip to fasten the strap of the goggle mask. At another side of the body, a pair of curved arms are formed and opposite to each other with a slot formed between them. Each arm has a free end with a stub bending radically outward. The holder has a smaller than outsider perimeter of the snorkel tube so that the holder may engage with the snorkel tube tightly and securely when in use. A user may use two fingers (of one hand) to press the stubs to disengage the holder from the snorkel tube for adjusting the position of the holder on the tube. The adjustment may be done easily and quickly with little effort.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
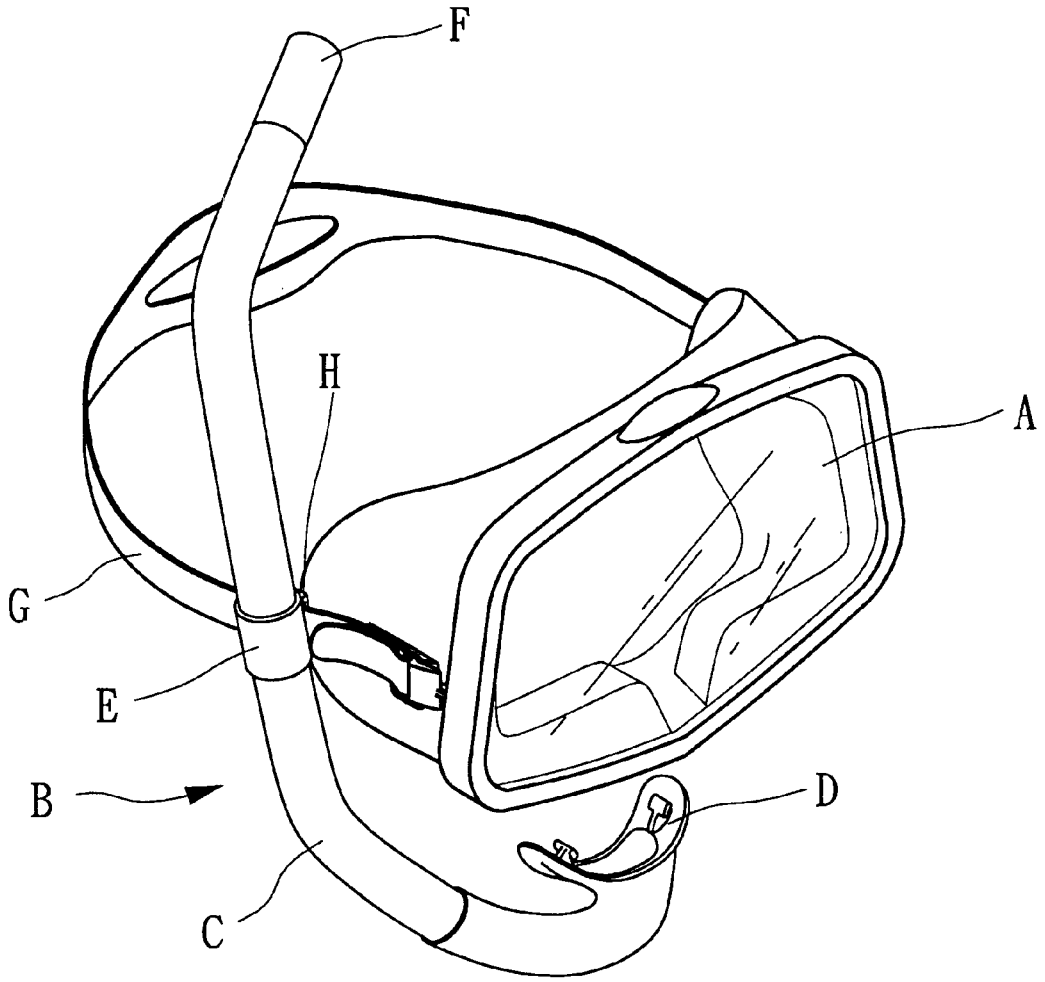
FIG. 1 (PRIOR ART)
FIG. 1 is a pictorial view of a conventional goggle mask for snorkeling.
Figure 2A:
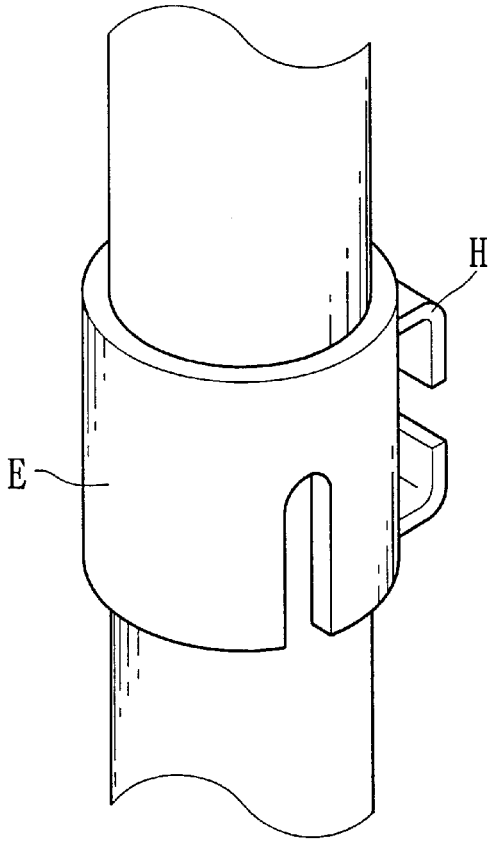
FIG. 2A (PRIOR ART)
FIG. 2A is a perspective view of a conventional snorkel tube holder.
Figure 2B:
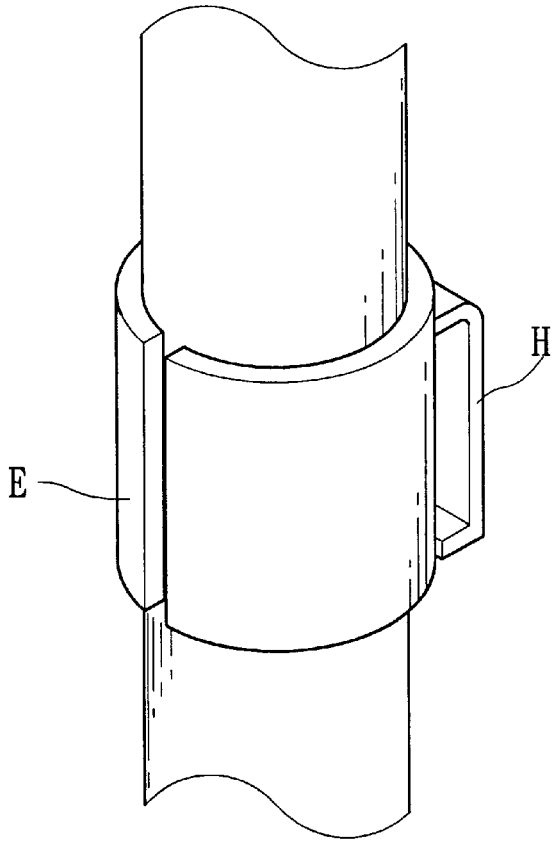
FIG. 2B (PRIOR ART)
FIG. 2B is a perspective view of another conventional snorkel tube holder.
Figure 3:
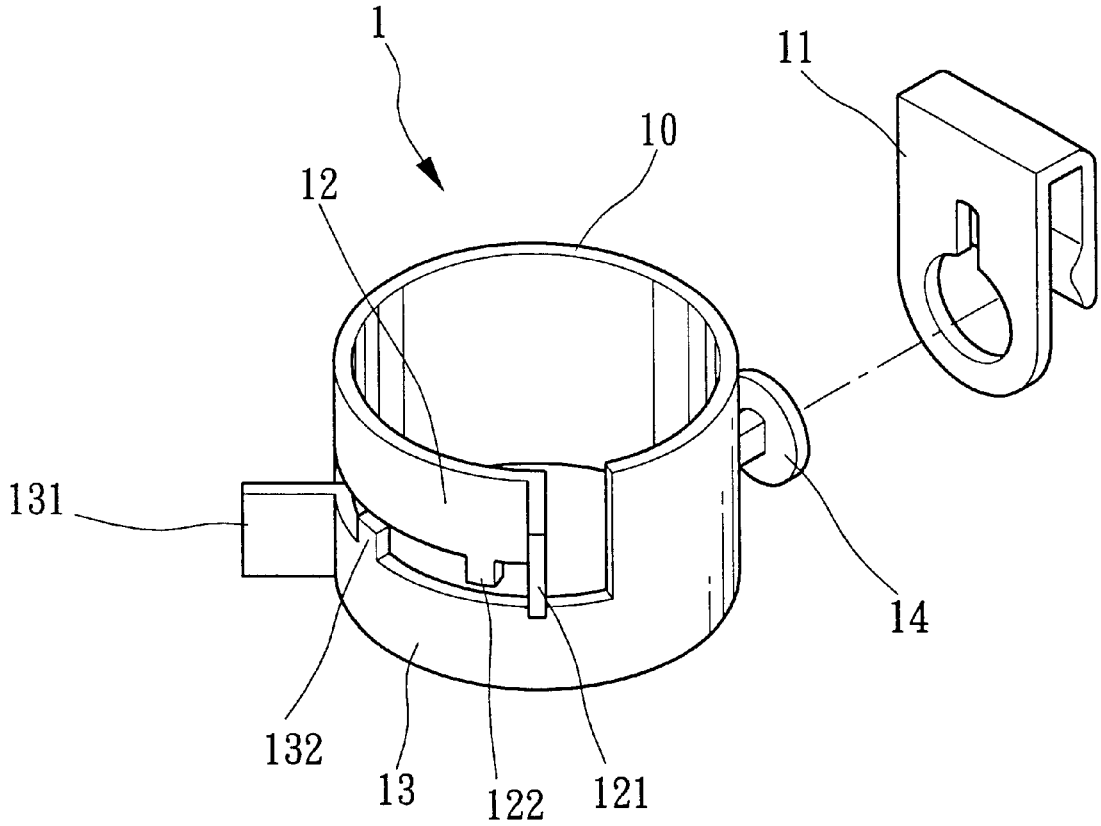
FIG. 3 is a perspective exploded view of this invention.
Figure 4:
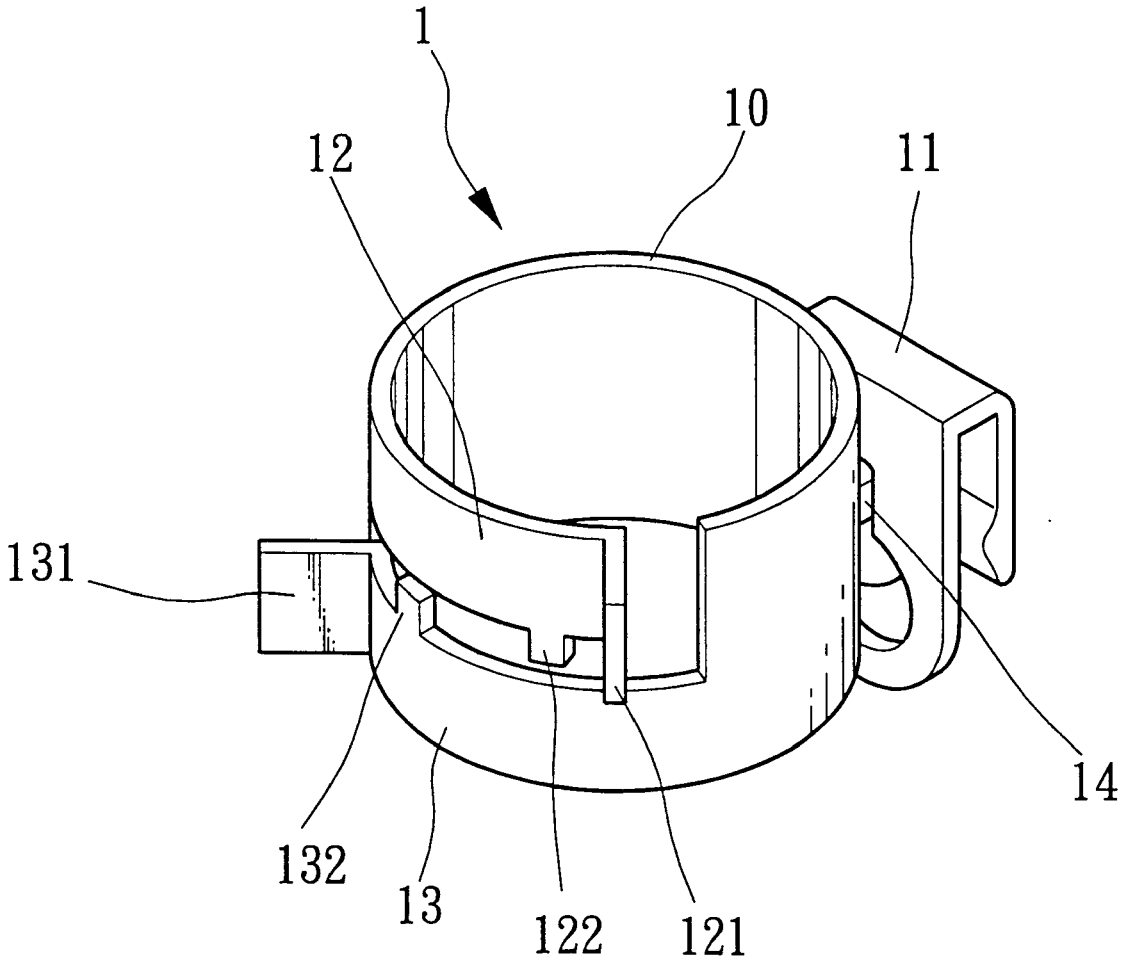
FIG. 4 is a perspective view of this invention.

Referring to FIG. 3 and 4, the snorkel tube holder 1 of this invention includes a hollow circular body 10 integrally made of injection molding plastics. At one side of the body 10, there is a fastener 14 engageable with a clip 11 for fastening the holder 1 to the strap 21 of the goggle mask (shown in FIG. 5).

Figure 5:
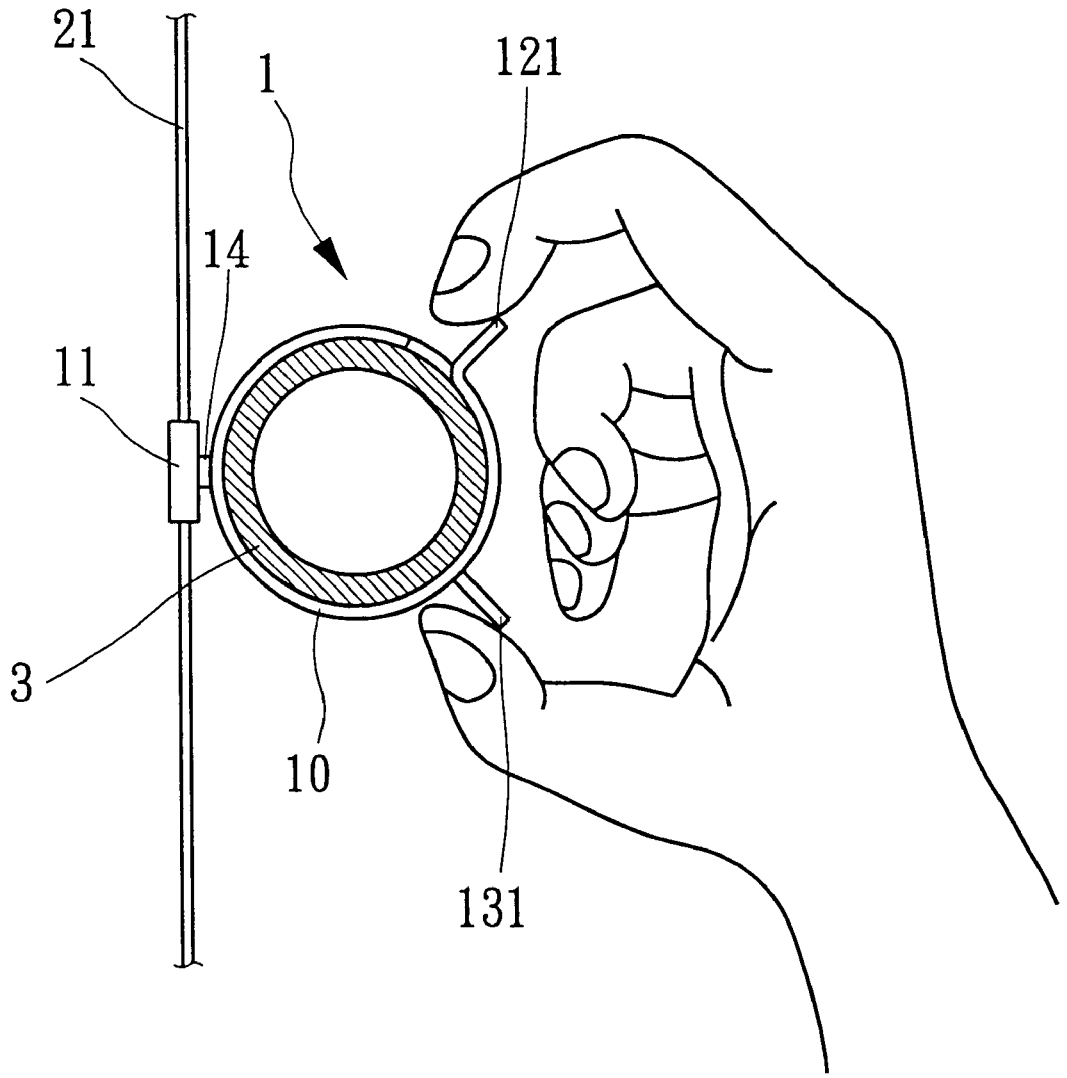
FIG. 5 is a pictorial view of this invention in use.

Another side of the body 10 has a curved first arm 12 which has a free end formed in a first lug 121 bent radially outward preferably 90 degree and a curved arm 13 which also has a free end formed in a second lug 131 bent radially outward preferably 90 degree. The first and second arm 12 and 13 are pointing in opposite direction with a slot set between them. The first arm 12 has a first stub 122 formed at one side facing the slot and extended in the slot. The second arm 13 also has a second stub 132 formed at one side facing the slot and extended in the slot but opposite to the first stub 122. The inside opening formed by the body is slightly smaller than the outside perimeter of the snorkel tube 3. Hence the holder 10 may engage with the snorkel tube tightly and securely When in use (FIG. 5).

When there is a need for changing and adjusting the position of holder 10 on the snorkel tube 3, a user may use two fingers of one hand to press the first and second lugs 121 and 131 against each other (shown in FIG. 5), the inside opening of the holder 10 may be enlarged. Then the holder 10 may be slightly disengaged from the snorkel tube 3 so that the holder 10 may be moved along the tube freely without much effort. The first and second stubs 122 and 132 set the movement limits of the arms 12 and 13. When the stubs 122 and 132 make contact with each other, the arms 12 and 13 may no longer be moved further for preventing the arms 12 and 13 from over extended and broken. Once the holder position is desirable, the fingers may be released from the lugs 121 and 131. The elastic force of the arms 12 and 13 will grip the snorkel tube 3 tightly again. It is to be noted that the clip 11 also may be integrally formed with the body 10 instead of separately made as shown in FIG. 3.

By means of the structure set forth above, a user may change and adjust the snorkel tube holder position easily and quickly single-handed. The snorkel tube surface won't be scraped into rough surface by the holder. And holder of this invention may be mass produced by injection molding at low cost.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

What is claimed is:

1. A snorkel tube holder for attaching a snorkel tube to a strap of a goggle mask comprising:

a) a resilient body for gripping the snorkel tube and having an arcuate portion, and first and second resilient curved arms extending in opposite directions from the arcuate portion, the curved arms being spaced apart and arranged side-by-side to define a slot therebetween, each curved arm having a free end;

b) first and second lugs extending outwardly from the free ends of the first and second curved arms, respectively;

c) first and second stubs extending from the first and second curved arms into the slot, the first and second stubs positioned so as to contact each other when the first and second arms are resiliently deformed, thereby preventing further deformation of the first and second arms; and, d) a clip having a generally U-shape and configured to engage the strap of the goggle mask, the clip being mounted on the arcuate portion of the resilient body.

2. The snorkel of claim 1 further comprising a fastener element extending from the arcuate portion of the resilient body and engaged with the clip.

* * * * *